US009699566B2

(12) United States Patent
Jurisch et al.

(10) Patent No.: US 9,699,566 B2
(45) Date of Patent: Jul. 4, 2017

(54) ELECTROMAGNETIC SIGNAL CONVERTER FOR AN OSTEOPHONE

(71) Applicant: BHM-Tech Produktionsgesellschaft m.b.H., Grafenschachen (AT)

(72) Inventors: Frank Jurisch, Bonn (DE); Franz Berl, Unterstinkenbrunn (AT); Klaus Hostniker, Vasoldsberg (AT)

(73) Assignee: BHM-TECH PRODUKTIONSGESELLSCHAFT M.B.H., Grafenschachen (AT)

( * ) Notice: Subject to any disclaimer, the term of this patent is extended or adjusted under 35 U.S.C. 154(b) by 0 days.

(21) Appl. No.: 15/052,256

(22) Filed: Feb. 24, 2016

(65) Prior Publication Data

US 2016/0261958 A1 Sep. 8, 2016

(30) Foreign Application Priority Data

Mar. 5, 2015 (AT) ..... A 50175/2015

(51) Int. Cl.
*H04R 1/00* (2006.01)
*H04R 11/02* (2006.01)
(Continued)

(52) U.S. Cl.
CPC ..... *H04R 11/02* (2013.01); *H04R 9/025* (2013.01); *H04R 31/006* (2013.01);
(Continued)

(58) Field of Classification Search
USPC ..... 381/396, 151, 412
See application file for complete search history.

(56) References Cited

U.S. PATENT DOCUMENTS 6,751,334 B2 * 6/2004 Hakansson ..... H04R 9/025 381/152
2003/0034705 A1 2/2003 Hakansson
(Continued)

FOREIGN PATENT DOCUMENTS

| | | |
|---|---|---|
| CN | 203840522 U | 9/2014 |
| SE | 447948 B | 12/1986 |
| WO | 2011163115 A1 | 12/2011 |

OTHER PUBLICATIONS

Office Action in Austrian Appl. No. A 50175/2015, mailed Nov. 17, 2015.

(Continued)

*Primary Examiner* — Sunita Joshi
(74) *Attorney, Agent, or Firm* — Nevrivy Patent Law Group P.L.L.C.

(57) ABSTRACT

The present invention provides an electromagnetic signal converter for an osteophone, comprising a soft magnetic yoke, an electrical coil arranged concentrically to the longitudinal axis of the yoke, an elastically suspended, soft-magnetic armature which, viewed in the direction of the longitudinal axis of the yoke, is separated from the yoke by a working air gap and can move along the longitudinal axis of the yoke, and a permanent magnet which is magnetized in the direction of the longitudinal axis of the yoke in order to generate a magnetic biasing voltage of the yoke and of the armature, characterized in that the permanent magnet and the coil do not overlap one another in the direction of the longitudinal axis of the yoke and that means is provided for dividing the magnetic flux that can be produced by the coil onto at least two flux paths, wherein one flux path runs outside of the permanent magnet, and characterized in that the permanent magnet, yoke and coil are surrounded in the signal converter of the invention by a soft magnetic housing which is separated by an air gap from the armature and from (Continued)

Figure 1:
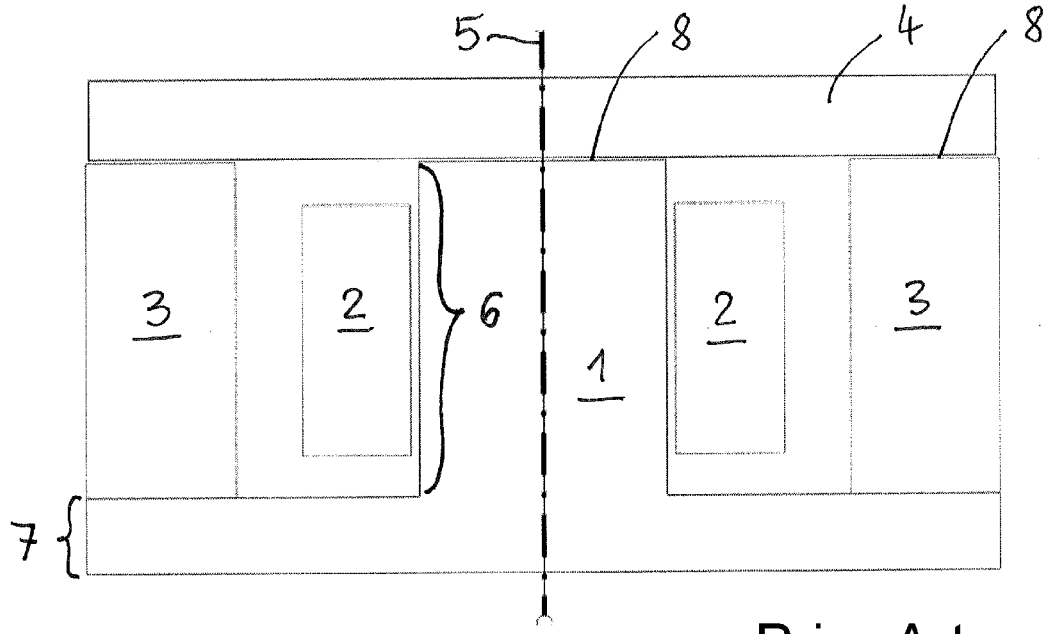
Prior Art Fig. 1

the yoke so that the magnetic flux which can be generated by the coil can be guided by the soft magnetic housing onto a flux path outside of the permanent magnet.

13 Claims, 3 Drawing Sheets

(51) Int. Cl.
*H04R 9/02* (2006.01)
*H04R 31/00* (2006.01)
*H04R 25/00* (2006.01)

(52) U.S. Cl.
CPC ..... *H04R 25/606* (2013.01); *H04R 2209/022* (2013.01); *H04R 2209/024* (2013.01); *H04R 2460/13* (2013.01)

(56) References Cited

U.S. PATENT DOCUMENTS

| | | | |
|---|---|---|---|
| 2004/0028249 | A1 | 2/2004 | Asnes |
| 2004/0236176 | A1 | 11/2004 | Asnes |
| 2014/0012069 | A1 | 1/2014 | Ball |

OTHER PUBLICATIONS

English translation of Office Action in Austrian Appl. No. A 50175/2015, mailed Nov. 17, 2015.
European Search Report from European Application No. 16158871, mailed on Jul. 8, 2016.

* cited by examiner

ELECTROMAGNETIC SIGNAL CONVERTER FOR AN OSTEOPHONE

BACKGROUND OF THE INVENTION (1) Field of the Invention

The invention relates to an electromagnetic signal converter for an osteophone, comprising

- a soft magnetic yoke,
- an electrical coil arranged concentrically to the longitudinal axis of the yoke,
- an elastically suspended, soft-magnetic armature which, viewed in the direction of the longitudinal axis of the yoke, is separated from the yoke by a working air gap and can move along the longitudinal axis of the yoke, and
- a permanent magnet which is magnetized in the direction of the longitudinal axis of the yoke in order to generate a magnetic biasing voltage of the yoke and of the armature.

The magnetic biasing voltage generates during the operation of the electromagnetic signal converter a current-proportional production of force on the armature and therefore an exact transfer of the electrical oscillations into mechanical oscillations. Without this magnetic biasing voltage the force and therefore the mechanical deflection would be proportional to the square of the current, which would result in a significant distortion by the frequency doubling and the suppression of the weak signals.

(2) Description of Related Art

Osteophones, as they are known from the prior art, convert electrical signals into mechanical oscillations and therefore function as oscillation generators or electromagnetic signal converters. This technology is used, among other things, in hearing aids and is especially suitable for persons with impairment of the outer ear and of the middle ear since in this case the sound cannot be mechanically transferred to the cochlea. However, osteophones can also be used in other hearing systems and communication systems where a transmission of sound through the air to the eardrum is not possible, for example, under water. Therefore, osteophones can be used in communication systems for divers. Osteophones can also be used in communication systems in which a transmission of sound through the air is basically possible but transmitted sound is hardly audible on account of surrounding noise such as in heavy industry (e.g. in steel mills).

The acoustical signal to be transferred to the person is recorded as a rule by a microphone (however, it could also be transferred as a radio signal), converted in an amplifier, prepared and forwarded as an electrical signal to the electromagnetic signal converter. In the signal converter the electrical signals are supplied to the coil which causes the armature to oscillate in a corresponding manner. The oscillator (osteophone) serving as armature contacts the skull bone, preferably the mastoid bone, wherein the acoustic signal is transmitted in the form of tactile oscillations while circumventing the middle ear directly into the inner ear where it is converted into a nerve stimulation in the cochlea.

These osteophones are usually built into a carrier object, for example, into a spectacle frame, a hair loop or into an external housing for wearing in a head covering.

The traditional construction of the signal converter has the disadvantage that the permanent magnet is constructed as an annular magnet, that is, it has the shape of a hollow cylinder which surrounds an annular coil and makes contact on a front side with a disk-shaped part of the yoke, the yoke plate, while on the other front side it faces the armature while maintaining an air gap, a so-called working air gap. This has the disadvantage that the magnetic flux excited by the magnetic flux of the permanent magnet as well as the magnetic flux excited by the coil use the same flux paths, namely, in the longitudinal direction through the yoke, in particular through a rod-shaped part of the yoke (yoke core), radially through the armature into the annular magnet, in the longitudinal direction through the annular magnet and again into the yoke, in particular radially through the yoke plate back into the yoke core. That means that even the coil flux must overcome the high magnetic resistance of the annular magnet. Therefore, in order to produce a certain magnetic change of flux through the coil a high, electrically excited flowthrough (large ampere windings) is required. This is equivalent to a high current or a high winding number, and in any case a high exciter output is needed for the coil, which again has as consequence a low service life of the battery of the osteophone.

BRIEF SUMMARY OF THE INVENTION

Therefore, a problem of the present invention is to overcome the disadvantages of the prior art and to make an electromagnetic signal converter available which requires less exciter output for the coil.

This problem is solved by an electromagnetic signal converter according to Claim 1. Starting from an electromagnetic signal converter for an osteophone, comprising

- a soft magnetic yoke,
- an electrical coil arranged concentrically to the longitudinal axis of the yoke,
- an elastically suspended, soft-magnetic armature which, viewed in the direction of the longitudinal axis of the yoke, is separated from the yoke by a working air gap and can move along the longitudinal axis of the yoke, and
- a permanent magnet which is magnetized in the direction of the longitudinal axis of the yoke in order to generate a magnetic biasing voltage of the yoke and of the armature, it is provided that the permanent magnet and the coil do not overlap one another in the direction of the longitudinal axis of the yoke and that means is provided for dividing the magnetic flux that can be produced by the coil onto at least two flux paths, wherein one flux path runs outside of the permanent magnet. Of course, even the magnetic flux of the permanent magnet is divided onto at least two flux paths by this means.

This means that a parallel connection of the magnetic resistance of the permanent magnet and of another magnetic resistance occurs so that the magnetic resistance of the permanent magnet is reduced—in comparison to the prior art with a concentric coil and a permanent magnet which overlap one another in the longitudinal direction. This minimizes the total magnetic resistance of the magnetic circuit viewed from the coil. As a result, a lesser exciter output of the coil is sufficient for the same deflection of the armature. Consequently, the battery operating time is also lengthened in comparison to traditional signal converters. The use of a flat, plate-shaped permanent magnet can also contribute to the reduction of the total magnetic resistance, as will be explained later.

The magnetic flux which can be generated by the coil can be guided most simply by the yoke onto a flux path outside of the permanent magnet. In other words, the yoke is the means for dividing the magnetic flux which can be generated by the coil onto at least two flux paths. The yoke, that is present in any case, can therefore be constructed in an appropriate manner for the purpose of the invention.

An embodiment provides that the yoke comprises a rod-shaped yoke core aligned along the longitudinal axis of the yoke and comprises a yoke plate arranged normally to the longitudinal axis, wherein the yoke core extends into the coil and the yoke plate faces a front side of the coil, and the magnetic flux which can be produced by the coil can be guided by the yoke plate onto a flux path outside of the permanent magnet. The yoke plate does not necessarily have to be plate-shaped in the sense of a prism (a body with the same thickness with front surfaces parallel to each other) but can basically also have other, non-prismatic shapes such as the shape of a truncated cone or of a cone. The yoke plate can be circular, in particular a circular disk, or rectangular, in particular a rectangular plate, as a function of the geometry of the signal converter viewed in the direction of the longitudinal axis of the yoke. The dimension of the yoke plate normal to the longitudinal axis of the yoke as a rule is greater than the dimension of the yoke plate in the direction of the longitudinal axis of the yoke.

As a result of an arrangement of the permanent magnet located on the side of the yoke opposite the armature—viewed in the direction of the longitudinal axis of the yoke—a part of the yoke, namely, the yoke plate, is located between the coil and the permanent magnet and therefore serves as a leakage path for the magnetic fields of the coil and of the permanent magnet. A part of the magnetic field lines that penetrate from the permanent magnet into the yoke plate run back again into the permanent magnet and not through the entire yoke. A lower total magnetic resistance results for the magnetic flux of the coil from the parallel connection of the permanent magnet resistance and the leakage path resistance, as a result of which a lower exciter output of the coil is achieved for the same deflection of the armature.

The magnetic resistance is defined by considering the signal converter as a magnetic circuit. A magnetic circuit is a closed path of a magnetic flux. The laws of the magnetic flux are analogous to the laws in the electrical circuit. The magnetic flux $\Phi$ is considered analogous here to the electrical current I, the magnetic resistance (the reluctance Rm) analogous to the electrical resistance (to the resistance R) and the magnetic voltage Vm analogous to the electrical voltage U. Analogous to the electrical resistance, in the magnetic circuit the magnetic resistance Rm can be defined as the quotient from the magnetic voltage Vm and the magnetic flux $\Phi$.

The permanent magnet, yoke and coil can be surrounded in the signal converter of the invention by a soft magnetic housing which is separated by an air gap from the armature and from the yoke so that the magnetic flux which can be generated by the coil can be guided by the soft magnetic housing onto a flux path outside of the permanent magnet. An air gap can be present between a front surface of the yoke, especially the yoke plate, which surface faces the permanent magnet, and between the housing.

If the permanent magnet is constructed with a plate shape, its extension in the direction of the longitudinal axis of the yoke is therefore small in comparison to its extension normal to the longitudinal axis, the magnetic resistance of the permanent magnet in the direction of the longitudinal axis is also small since the magnetic resistance is proportional to the thickness $h_M$ of the plate-shaped permanent magnet and inversely proportional to the surface $A_M$ of the permanent magnet: $Rm=h_M/(\mu_0*\mu_p*A_M)$.

The plate-shaped permanent magnet can be designed to be especially thin and therefore compact and with low resistance ($Rm=h_M/(\mu_0*\mu_p*A_M)$) as a rare-earth magnet. The name rare-earth magnet comprises a group of permanent magnets consisting substantially of iron metals (iron, cobalt) and rare earth metals (in particular neodymium, samarium, praseodymium, dysprosium and terbium. They are distinguished in that they simultaneously have a high magnetic remanence flux density $B_r$ and a high magnetic energy density $(BH)_{max}$. Current rare earth magnets consist, for example, of neodymium-iron-boron (Nd2Fe14B) or samarium-cobalt ($SmCo_5$ and $Sm_2Co_{17}$). The magnetic energy density of rare earth magnets is as a rule one multiple higher than that of steel magnets, e.g. consisting of Alnico. As a result of the lesser dimensions of the rare earth magnets—in comparison to a traditional annular magnet—the weight of the permanent magnet is decreased and with it that of the signal converter.

The permanent magnet is as a rule constructed as a circular disk for reasons of symmetry, wherein the middle point of the circular disk lies on the longitudinal axis of the yoke.

It is especially favorable if the permanent magnet has a diameter that is smaller than the outside diameter of the coil but greater than the inside diameter of the coil. However, the permanent magnet could also be equally as large as or larger than the outside diameter of the coil. The required magnetic flux and therefore substantially the magnetic surface $A_M$ are decisive for the designing of the dimensions of the permanent magnet.

It can be provided that the greatest diameter of the yoke, in particular of the yoke plate, has the same outside diameter as the coil.

The signal converter can be constructed in such a manner that an air gap, the so-called leakage air gap, is present between a circumferential surface of the yoke, in particular a circumferential surface of the yoke plate and the housing. This air gap therefore has, for example, the shape of a cylindrical jacket. The air gap between the yoke plate and the housing causes a generation of force according to $F=B^2*A/2\mu_0$.

It can be provided that the yoke, in particular the yoke plate, has a recess in its front side which faces the permanent magnet so that the permanent magnet is received at least partially in the yoke. This brings about a fixing of the position of the permanent magnet and of the yoke.

It can be analogously provided with the same effect that the soft magnetic housing has a recess which faces the permanent magnet so that the permanent magnet is received at least partially in the housing.

An embodiment of the invention consists in that the permanent magnet makes contact with its front sides with the yoke, in particular the yoke plate and also with the housing. In this manner an additional air gap is avoided. This brings about a good magnetization of the yoke plate and of the housing, wherein the magnetic field lines run primarily in this area.

BRIEF DESCRIPTION OF THE SEVERAL VIEWS OF THE DRAWING(S)

The invention will now be explained in detail using exemplary embodiments. The drawings are given by way of example and are intended to present the concept of the invention but are not limiting in any case and do not show it in a conclusive manner.

Figure 2:
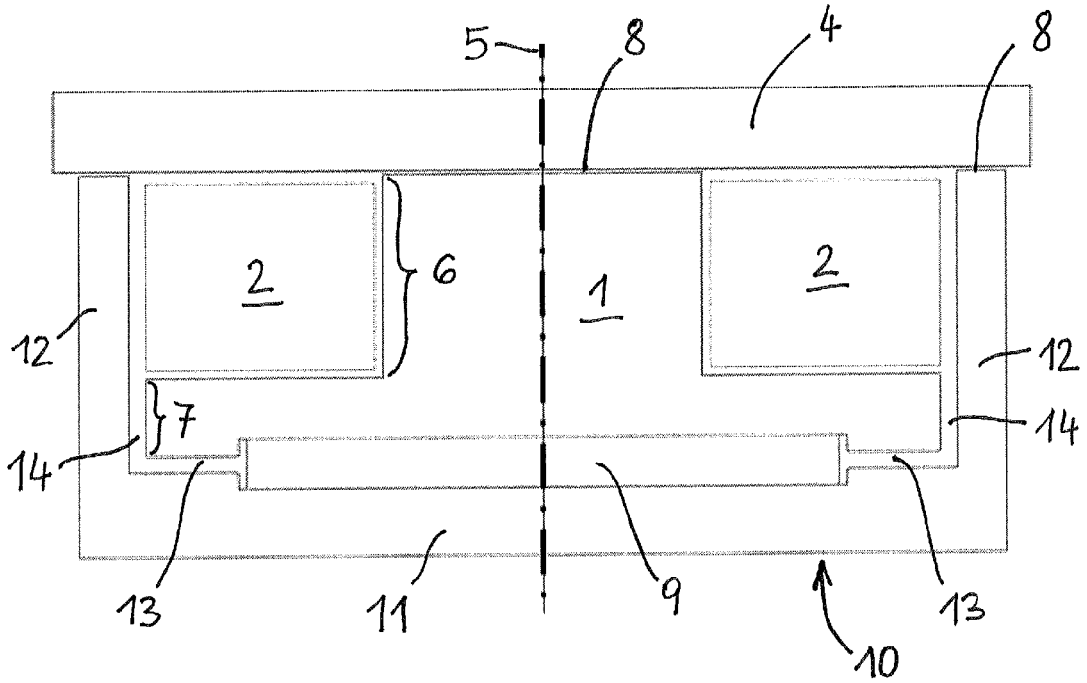
Figure 3:
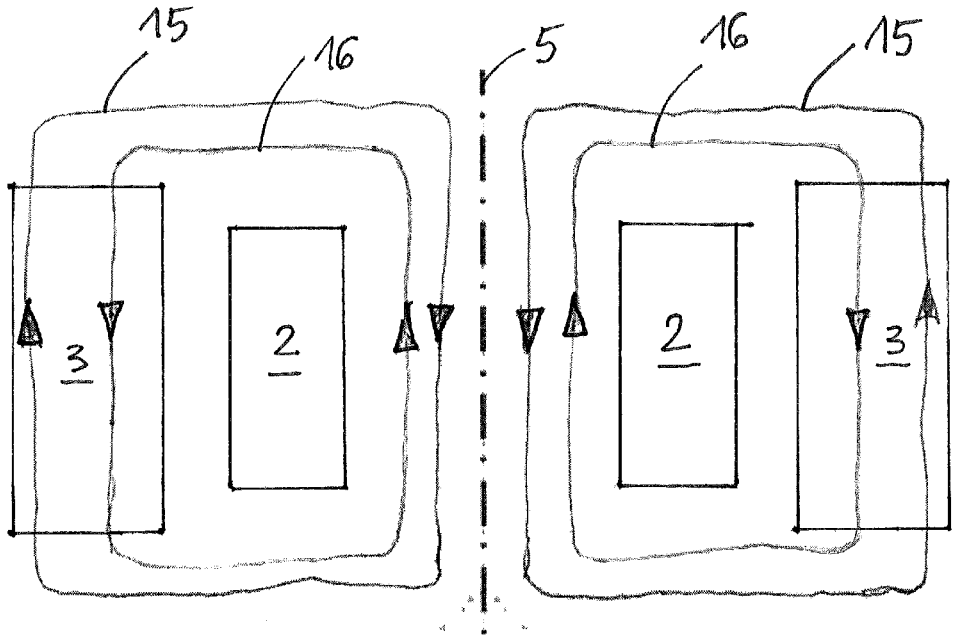
Prior Art Fig. 3
Figure 4:
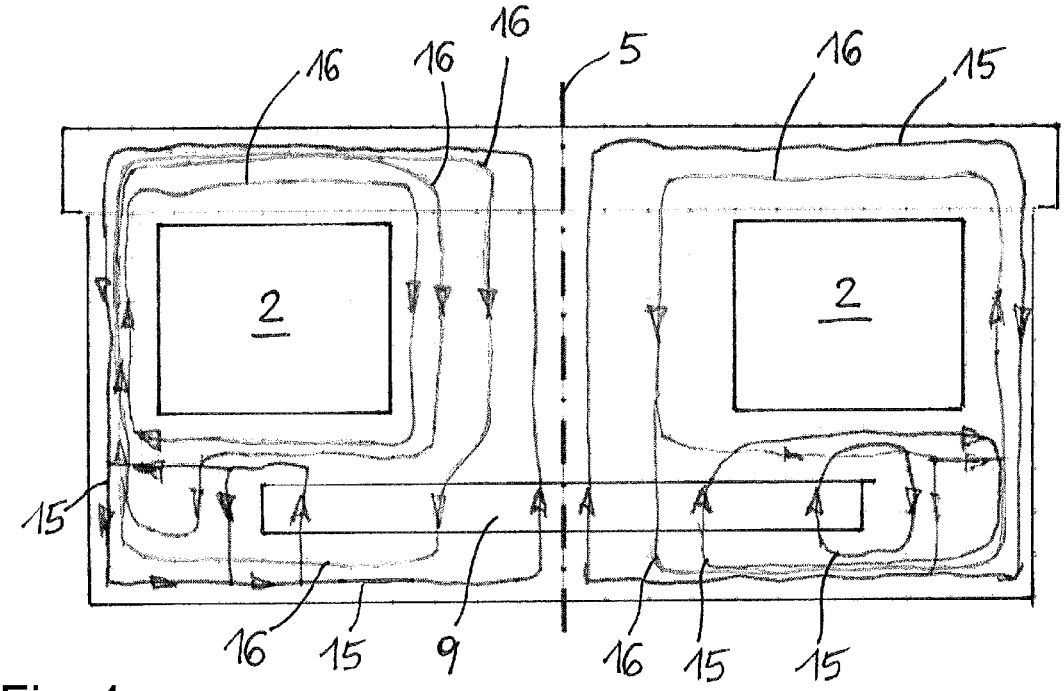
Figure 5:
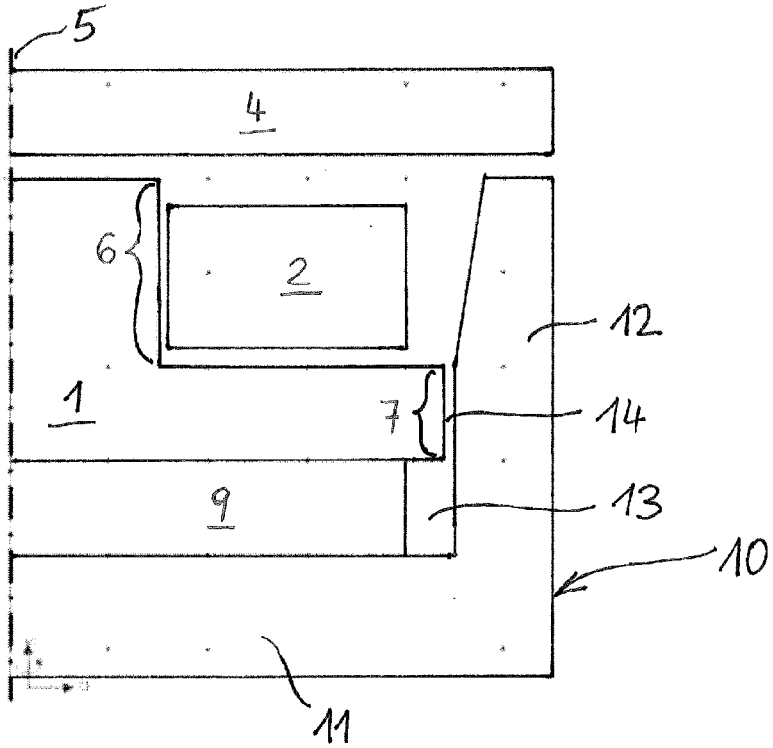
Figure 6:
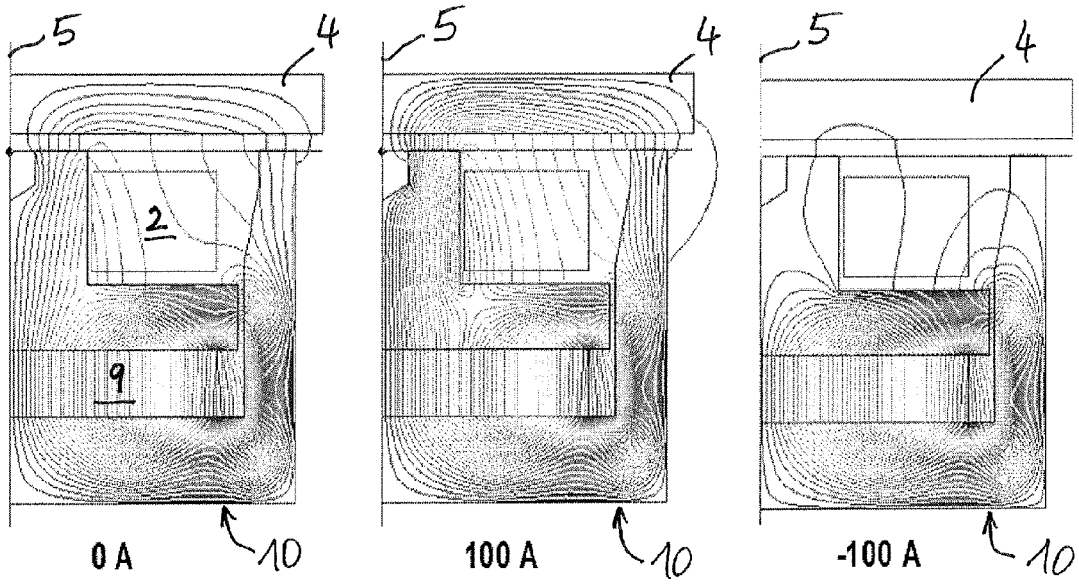

In the figures:

FIG. 1 shows a longitudinal section through a schematically shown signal converter according to the prior art, FIG. 2 shows a longitudinal section through a schematically shown signal converter in accordance with the invention, FIG. 3 shows the longitudinal section from FIG. 1 with magnetic field lines, FIG. 4 shows the longitudinal section from FIG. 2 with magnetic field lines, FIG. 5 shows a longitudinal section through an alternative signal converter in accordance with the invention, FIG. 6 shows longitudinal sections from FIG. 5 with different magnetic field lines based on a different coil excitation.

DETAILED DESCRIPTION OF THE INVENTION

FIG. 1 shows a traditional signal converter. It consists substantially of a yoke 1, a coil 2, an annular magnet 3 and a plate-shaped armature 4. An encasing housing which surrounds all cited parts of the signal converter and is protected against environmental influences is not shown here.

The yoke 1 as well as the coil 2, the annular magnet 3 and the armature 4 are constructed in a rotationally symmetrical manner about the longitudinal axis 5. It is manufactured in one piece but comprises areas with different diameters along the longitudinal axis 5, comprises a rod-shaped part, that is, a middle shank or yoke core 6 with a smaller diameter and a disk-shaped part, that is, a yoke plate 7 with a larger diameter. The yoke core 6 is as a rule longer than the yoke plate 7. The length of the yoke core 6 is dimensioned so that it entirely penetrates the coil 2 which is set on it concentrically to the yoke 1. The yoke plate 7 is as a rule dimensioned so that it has at least the same or a greater diameter than the coil 2. The yoke 1 can be manufactured, e.g. from magnetic high-grade steel or Mu metal.

In FIG. 1 the diameter of the yoke plate 7 is as large as that of the annular magnet 3. The annular magnet 3 is arranged concentrically to the yoke 1 and is here higher than the coil 2—measured in the direction of the longitudinal axis 5. The annular magnet 3 is magnetized parallel to the longitudinal axis 5 and is constructed, e.g. as an AlNiCo magnet. The annular magnet 3 sits with a front surface on the front surface of the yolk plate 7 which faces the yoke core 6. The annular magnet 3 extends with its other front surface toward the armature 4 up to a working air gap 8 for the armature 4. The yoke core 6 also extends with its front surface toward the armature up to a working air gap 8 for the armature 4.

The armature 4 can be manufactured from the same material as the yoke 1. The armature 4 is elastically suspended, for example on the surrounding housing of the signal converter which is not shown here, so that it can move freely opposite the yoke 1 and the annular magnet 3 along the longitudinal axis 5.

A series circuit of the magnetic resistances of the working air gap 8, yoke core 6, yoke plate 7, annular magnet 3, working air gap 8 and armature 4 is present in FIG. 1—when considering the signal converter as a magnetic circuit. Both magnetic fluxes (electrically excited by coil 2 and permanently excited by annular magnet 3) use this path. The magnetic resistance of the AlNiCo magnet is very great and determining for the arrangement on account of its great magnetic height (in the direction of the longitudinal axis 5) and the relatively small surface (normal to the longitudinal axis 5).

FIG. 2 shows a signal converter according to the invention. It consists substantially of a yoke 1, of a coil 2 and of a plate-shaped armature 4 as well as—in distinction to FIG. 1—of plate-shaped permanent magnet 9 shaped like a circular disk and of a housing (or pot) 10, consisting here of jacket 12 and base plate (bottom) 11. A surrounding housing that encloses all cited parts of the signal converter and protects against environmental influences is not shown here.

Yoke 1 as well as the coil 2, the permanent magnet 9, the armature 4 and the housing 10 are constructed in a rotationally symmetrical manner all around the longitudinal axis 5 of the yoke 1. The yoke 1 is manufactured in one part but has areas along the longitudinal axis 5 with different diameters, has a yoke core 6 with smaller diameter and a yoke plate 7 with a greater diameter. Both parts 6, 7 have a cylindrical shape here. The yoke core 6 is as a rule longer than the yoke plate 7. The length of the yoke core 6 is dimensioned so that it completely passes through the coil 2, that is concentric to yoke 1 and placed on it. The yoke core 6 has approximately the same length and height here as the coil 2. The yoke plate 7 is dimensioned in such a manner as a rule that it has at least the same diameter—as here—or a greater diameter than the coil 2. The yoke 1 can, e.g. again be manufactured from magnetic high-grade steel or Mu metal. The armature 4 can be manufactured from the same material as the yoke 1.

The armature 4 is, e.g. mechanically suspended on a spring. The armature 4 is attracted from yoke 1 and housing 10 by the magnetic biasing voltage of the soft magnetic circuit consisting of yoke 1, armature 4 and housing 10 by permanent magnet 9 and the rest working air gap 8 is set. Coil 2 receives current and, depending on the polarity of the current, the magnetic flux of the permanent magnet 9 is amplified or reduced. This changes the magnetic force on the armature 4 and the latter moves proportionally to the change in current. The movement of the armature 4 is transferred—for example via a surrounding housing—onto the skull bone.

The diameter of the permanent magnet 9 is smaller here than that of the yoke plate 7. It is approximately only two thirds of the diameter of the disk-shaped part 7. The permanent magnet 9 is arranged concentrically to the yoke 1 and is thinner here (measured in the direction of the longitudinal axis 5—than the coil 2 or the yoke plate 7. The permanent magnet 9 is a rare earth magnet and is magnetized parallel to the longitudinal axis 5. The permanent magnet 9 contacts with a front surface the yoke plate 7 on its front surface which faces away from the yoke core 6. With its other front surface the permanent magnet 9 contacts the housing 10, namely its base plate 11.

The housing 10 is cup-shaped and comprises a level base plate 11 here as well as a cylindrical jacket 12. The housing 10 is manufactured here in one part. It can be manufactured from the same soft magnetic material as the yoke 1 or the plate-shaped armature 4.

The housing 10 together with the armature 4 surrounds the yoke 1, the coil 2 and the permanent magnet 9. A working air gap 8 is provided between the front surface of the cylindrical jacket 12 of the housing 10 and the armature 4. The armature 4 is elastically suspended on a surrounding housing, which is not shown here, of the signal converter so that it can oscillate in the direction of the longitudinal axis 5 in accordance with the variable magnetic field given by the coil 2. Also, the yoke core 6 extends with its front surface toward the armature 4 to a working air gap 8 for the armature 4.

The base plate 11 of the housing 10 comprises on its inner side a circular, disk-shaped recess into which the permanent magnet 9 is set. The depth of the recess—measured along the longitudinal axis 5—corresponds here to approximately one fourth of the thickness of the permanent magnet 9 so that the latter still projects approximately halfway out of the recesses. Also, the yoke plate 7 comprises a circular, disk-shaped recess in the front side which faces the permanent magnet 9 and into which the permanent magnet 9 is set. The depth of the recess—measured along the longitudinal axis 5—also corresponds here to approximately one fourth of the thickness of the permanent magnet 9. A radial distance of the permanent magnet 9 to the wall of each recess is provided. This distance serves for the ready centering of permanent magnet 9 and in particular of the air gap (leakage air gap) 14. The recess in the yoke plate 7 is just as large here as the one in the base plate 11.

An air gap 13, that has an annular shape here, is located between the front surface, facing the permanent magnet 9, of the yoke plate 7 and the base plate 11 of the housing 10. Its radial width—measure normally to the longitudinal axis 5—amounts to approximately one third of the radius of the yoke plate 7 and its axial width —measured in the direction of the longitudinal axis 5—is smaller here than the height of the permanent magnet 9. In other embodiments of the invention the air gap 13 can of course have other relative radial widths and heights. Another air gap 14 is located between the circumferential surface of the yoke plate 7 and the jacket 12 of the housing 10. Its axial height—measured in the direction of the longitudinal axis 5—corresponds to the height of the yoke plate 7.

The two air gaps 13, 14 merge into one another so that a through, bent air gap is produced between the circumferential surface of the permanent magnet 9 and the armature 4.

The air gaps 13, 14 are designed in such a manner relative to the permanent magnet 9 that a sufficiently high magnetic biasing voltage is generated by the permanent magnet 9 and the magnetic resistances are held as small as possible for the electrically excited flux of the coil 2. This concerns in particular the parallel circuit of the magnetic resistances of permanent magnet 9, air gap 13 and air gap 14. The working air gap 8 is given by its function as armature movement space. As a rule no large magnetic resistances (mag. voltage drops) should be produced in the soft magnetic material. The design of the signal converter, in particular of air gaps 13, 14 of the permanent magnet 9 but also of the shape and dimensions of the yoke plate 7 can again take place by calculating the above-cited magnetic circuit, where the individual structural components (magnetic conductor, magnetic resistances, magnetic coupling element) are connected to each other in an appropriate manner.

The different course of the magnetic field lines resulting from the signal converter of the invention is apparent by a comparison of FIGS. 3 and 4. They show the field lines 15 of the particular permanent magnet, therefore of annular magnet 3 from FIG. 1 and of the disk-shaped permanent magnet 9 from FIG. 2 as well as the field lines 16 of coil 2.

In FIG. 3 the field lines of the signal converter from FIG. 1 are sketched in. The field lines 15 produced by the annular magnet 3 and also the field lines 16 produced by the coil 2 are present in the same areas. They run in the direction of the longitudinal axis 5 through the yoke core 6, radially through the armature 4 into the annular magnet 3, in the direction of the longitudinal axis 5 through the annular magnet 3 and radially through the yoke plate 7 back into the yoke core 6. This means that even the coil flux must overcome the high magnetic resistance of the annular magnet 3.

The field lines of the signal converter from FIG. 2 are sketched in FIG. 4. Even here the field lines 15 produced by the permanent magnet 9 run partially through the same areas as the field lines 16 produced by the coil 2. They run namely in the direction of the longitudinal axis 5 through the yoke core 6, radially through the armature 4 into the jacket 12 of the housing 10, in the direction of the longitudinal axis 5 through the jacket 12 and radially through the base plate 11 of the housing 10 again in a longitudinal direction through the permanent magnet 9 into the yoke core 6.

However, the magnetic field lines are conducted through the arrangement of the yoke plate 7 between the permanent magnet 9 and the coil 2 in accordance with the soft magnetic materials and are divided as a function of the magnetic resistances which are primarily determined by the air gaps 13, 14 and the permanent magnet 9. In this manner even field lines 15 of the permanent magnet 9 are formed which run only in the area of the permanent magnet 9, of the yoke plate 7, the base plate 11 of the housing 10 and of the cylindrical jacket 12 of the housing 10 but in the direction of the longitudinal axis 5 they do not run over the height of the yoke plate 7. Therefore, these field lines 15 do not penetrate into the coil 2 whereas other field lines 15 do penetrate it, only they are so few that they are not sketched in here.

Likewise, a part of the field lines 16 of coil 2 change their course: they do not reach the base plate 11 of the housing 10 but rather run through the yoke plate 7 and therefore deviate from the permanent magnet 9 in order to close through the jacket 12 of the housing 10 and through the yoke core 6 again in the armature 4. Therefore, a few field lines 16 run from the armature 4 axially through the yoke core 6 in the direction of the permanent magnet 9, in front of the permanent magnet 9 radially through the yoke plate 7, then axially over the first air gap 13 to the base plate 11 of the housing 10 and radially outward over the base plate 11 into the jacket 12 and again into the armature 4.

A part of the magnetic field lines 16 of the magnetic field generated by the coil 2 between yoke 1 and housing 10 therefore runs through the yoke plate 7 and not through the permanent magnet 9.

FIG. 5 shows a longitudinal section through an alternative signal converter according to the invention, wherein only one half of the signal converter is schematically shown. The signal converter in FIG. 5 is basically constructed the same as in FIG. 2 but differs from FIG. 2 in that coil 2 and permanent magnet 9 have the same outside diameter which, however, is smaller than the outside diameter of the yoke plate 7. Therefore, different dimensions also result in the case of the air gaps 13, 14. Moreover, even the height of the coil 2 is less in FIG. 5 then the height of the yoke core 6.

FIG. 6 shows the longitudinal sections from FIG. 5 three times and in addition the magnetic field lines are sketched in with a differing electrical magnetomotive force. On the left the magnetic field is shown without the current feed of coil 2, in the middle with the current feed of coil 2 ("100 A") in the sense of an reinforcement of the magnetic field of the permanent magnet 9, on the right with the current feed of coil 2 ("−100 A") but in the sense of a compensation of the magnetic field of the permanent magnet 9. It can be readily recognized in the left image that the density of the magnetic field lines inside the coil 2 is low.

The signal converter constituting subject matter is used in hearing systems and communication systems as well as for hearing diagnostics wherein the associated osteophone is worn and used on a human or animal skull. The size of the osteophone headphone and therefore of the signal converter are to be dimensioned according to the use. In some embodiments of the signal converter constituting subject matter the latter is very small and its height from the base plate 11 of the housing 10 to the armature along the longitudinal axis 5 is then approximately 2-10 mm and the diameter of the housing 10 and of the approximately equally large armature 4 is 5-20 mm. The disk-shaped permanent magnet has, for example, a thickness of 0.5-0.7 mm but the thickness can also be less than 0.5 mm or greater than 0.7 mm. In other embodiments the diameter of the housing 10 can also be in the range of a few centimeters, approximately up to 6 or 7 cm or even up to 10 cm. Even greater signal converters, for example for animals greater than a human, are also conceivable.

Another embodiment of a signal converter in accordance with the invention would be the rectangular embodiment where permanent magnet 9, yoke plate 7 and coil 2, viewed in the direction of the longitudinal axis 5, have a substantially rectangular form.

The invention, see in particular FIGS. 2 and 5, divides the magnetic fluxes and ensures a small magnetic resistance of the permanent magnet 9 by a low height and a large surface, which can be best realized by RE magnets. Furthermore, the flux paths of the air gap 14 (leakage air gap) and of the air gap 13 next to the permanent magnet 9, which are connected in parallel from the viewpoint of the electrical exciting, ensure a further significant lowering of the total magnetic resistance. The magnetic flux of the permanent magnetic excitation of the magnetic biasing voltage is withdrawn from the working air gap 8. However, the magnetic surface is also greater in comparison to the one in FIG. 1 in order to compensate this. Care is also to be taken during the designing of the signal converter according to the invention that the leakage path, that is, the yoke plate 7 is not saturated in its outer area where both magnetic fluxes are added on one another.

LIST OF REFERENCE NUMERALS

1 Yoke
2 Electrical coil
3 Annular magnet
4 Armature
5 Longitudinal axis
6 Yoke core of the yoke 1
7 Yoke plate of the yoke 1
8 Working air gap
9 Permanent magnet
10 Housing
11 Base plate of the housing 10
12 Cylindrical jacket of the housing 10
13 Air gap (leakage air gap between yoke plate 6 and base plate 11)
14 Air gap (leakage air gap between yoke plate 6 and jacket 12)
15 Field line of the permanent magnet 9 or of the annular magnet 3
16 Field line of the coil 2

The invention claimed is:

1. An electromagnetic signal converter for an osteophone, comprising a soft magnetic yoke (1), an electrical coil (2) arranged concentrically to the longitudinal axis of the yoke (1), an elastically suspended, soft-magnetic armature (4) which, viewed in the direction of the longitudinal axis (5) of the yoke (1), is separated from the yoke (1) by a working air gap (8) and can move along the longitudinal axis (5) of the yoke (1), and a permanent magnet (9) which is magnetized in the direction of the longitudinal axis (5) of the yoke (1) in order to generate a magnetic biasing voltage of the yoke (1) and of the armature (4), characterized in that the permanent magnet (9) and the coil (2) do not overlap one another in the direction of the longitudinal axis of the yoke (1) and that means is provided for dividing the magnetic flux that can be produced by the coil (2) onto at least two flux paths, wherein one flux path runs outside of the permanent magnet (9), and characterized in that the permanent magnet (9), yoke (1) and coil (2) are surrounded in the signal converter of the invention by a soft magnetic housing (10) which is separated by an air gap (13, 14) from the armature (4) and from the yoke (1) so that the magnetic flux which can be generated by the coil (2) can be guided by the soft magnetic housing (10) onto a flux path outside of the permanent magnet (9).

2. The signal converter according to claim 1, characterized in that the magnetic flux which can be generated by the coil (2) can be guided by the yoke (1) onto a flux path outside of the permanent magnet (9).

3. The signal converter according to claim 1, characterized in that the yoke (1) comprises a rod-shaped yoke core (6) aligned along the longitudinal axis (5) of the yoke and comprises a yoke plate (7) arranged normally to the longitudinal axis, wherein the yoke core (6) extends into the coil (2) and the yoke plate (7) faces a front side of the coil (2), and the magnetic flux which can be produced by the coil (2) can be guided by the yoke plate (7) onto a flux path outside of the permanent magnet (9).

4. The signal converter according to one of claim 1, characterized in that the permanent magnet (9) is arranged, as regards the yoke (1), lying opposite the armature (4).

5. The signal converter according to claim 1, characterized in that the permanent magnet (9) is constructed with a plate shape.

6. The signal converter according to claim 1, characterized in that the permanent magnet (9) is a rare earth magnet.

7. The signal converter according to claim 1, characterized in that the permanent magnet (9) is constructed as a circular disk wherein the middle point of the circular disk lies on the longitudinal axis (5) of the yoke (1).

8. The signal converter according to claim 1, characterized in that the permanent magnet (9) has a diameter that is smaller than the outside diameter of the coil (2) but greater than the inside diameter of the coil (2).

9. The signal converter according to claim 1, characterized in that the greatest diameter of the yoke (1), in particular of the yoke plate (7), has the same outside diameter as the coil (2).

10. The signal converter according to claim 5, characterized in that an air gap is present between a circumferential surface of the yoke (1), in particular a circumferential surface of the yoke plate (7) and the housing (10).

11. The signal converter according to claim 1, characterized in that the yoke (1), in particular the yoke plate (7), has a recess in its front side which faces the permanent magnet (9) so that the permanent magnet (9) is received at least partially in the yoke.

12. The signal converter according to claim 1, characterized in that the soft magnetic housing (10) has a recess which faces the permanent magnet (9) so that the permanent magnet (9) is received at least partially in the housing (10).

13. The signal converter according to claim 1, characterized in that the permanent magnet (9) makes contact with its front sides with the yoke (1), in particular the yoke plate (7) and also with the housing (10).

* * * * *